US006000456A

United States Patent [19]

Neverett

[11] Patent Number: 6,000,456

[45] Date of Patent: Dec. 14, 1999

[54] ADJUSTABLE BLIND CLASP

[76] Inventor: Francis Neverett, P.O. Box 546, Chazy, N.Y. 12921

[21] Appl. No.: 09/140,126

[22] Filed: Aug. 25, 1998

[51] Int. Cl.[6] ..... E06B 9/36

[52] U.S. Cl. ..... 160/178.1 V; 160/177 V

[58] Field of Search ..... 160/173 V, 178.1 V, 160/168.1 V, 900, 177 V, 176.1 V, 405

[56] References Cited

U.S. PATENT DOCUMENTS

| | | | |
|---|---|---|---|
| 4,262,728 | 4/1981 | Debs | 160/168 |
| 4,869,309 | 9/1989 | Evans | 160/177 V |
| 4,964,191 | 10/1990 | Wyatt | 160/177 V X |
| 4,967,823 | 11/1990 | Gagnon | 160/177 V |
| 5,257,811 | 11/1993 | Biba | 160/168.1 V |
| 5,291,946 | 3/1994 | Ciriaci | 160/177 |
| 5,407,008 | 4/1995 | Boloix | 160/177 |

*Primary Examiner*—David M. Purol
*Attorney, Agent, or Firm*—Randall L. Reed

[57] ABSTRACT

A blind clasp for adjusting the height of the louvers of a vertical blind above a surface over which they have been suspended without the need to move the horizontal head rail. The clasp has a first end to which the louver of the blind is attached and a second end with two or more securing or ratchet points which can be attached to a holder of the vertical blind suspension mechanism and by changing or varying the securing point the height of the louver can be varied over the surface which it is suspended above.

9 Claims, 5 Drawing Sheets

ADJUSTABLE BLIND CLASP

FIELD OF THE INVENTION

This invention relates to a device to adjust a set of blinds. More particularly it provides a device with which to adjust the height of vertical blind louvers.

BACKGROUND OF THE INVENTION

Blinds have long been a popular method of providing a covering over a window or doorway. Their popularity in part, stems from the fact that they can quickly and easily be opened to allow in light or a view out of the door or window over which they are installed or closed to provide privacy and shelter from bright light. They also come in many designs and colors which can also act as a statement of style.

Vertical blinds make up a popular version of blinds in use today. The louvers of the vertical blinds hang suspended in a row attached to a horizontal track with suspension mechanisms. The suspension mechanisms slide on the vertical track allowing the louvers of the blind to be drawn over the opening or to the side out of the way of the opening. The blind also has a mechanism to rotate the louvers when they are in front of the opening to allow in light and a view out or to block light and the view out.

One critical factor in installing a vertical blind is that they must be installed at the right height above the surface, i. e. a floor or window sill, over which they will be suspended. This is to assure that there is sufficient clearance between the bottom ends of the louvers and the surface so that when the blind is opened or closed, the louvers have obstruction free movement from the open to the closed positions and visa versa. However, the ends of the louvers still must be close enough to the floor or window sill so that when the blind is closed it provides the complete privacy sought by use of the blinds.

Once vertical blinds are installed the height the louvers above the floor or window sill over which they are suspended can not be changes without removing the blind entirely and reinstalling it. Having to reinstall the blind not only involves added work and expense, it also causes further damage to the wall to which the blind is attached. Such work requires new holes to be made in the wall to anchor the horizontal support of the vertical blinds as well as other work on the wall to rehang the blinds.

A number of situations may necessitate the reinstallation of the blind to achieve the desired height of the blind above the floor or surface above which the louvers are suspended. When installed, a mistake might be made in measuring the correct distances, or the level of the floor may change due to a change in flooring such as the installation or removal of carpeting or some other type of floor covering.

SUMMARY

Thus, it is an object of the present invention to provide an efficient and effective means for adjustment of the height of the louvers of a vertical blind over the surface above which they are suspended.

It is yet another object of this invention to provide a device which can be easily and quickly manufactured and used with vertical blinds produced by a variety of manufacturers.

To achieve the object of the present invention it provides in one version an adjustable bind clasp for adjusting the height of the louvers of a vertical blind with respect to a surface, the clasp having a first end for detachably holding a louver of a vertical blind and at least one securing point at a second end which is positionable within a vertical blind suspension mechanism such that the securing point detachably engages a holder of the vertical blind suspension mechanism. In a further aspect, the clasp has several securing points spaced out along its second end, each of which is capable of detachably securing the clasp to the holder such that attaching the clasp at the different securing points allows for the positioning of the louver at different heights above the surface.

In another variation of the invention, it provides a vertical blind consisting of a vertical blind frame attachable in a horizontal orientation to a wall above an opening in the wall, the frame has an array of vertical blind suspension mechanisms for lateral and rotational movement of a vertical blind louver that each suspension mechanism holds suspended over a surface; a vertical blind clasp with a first end to detachably but securely hold a vertical blind louver and a second end with at least one securing point which can be detachably but securely connected to a holder of the vertical blind suspension mechanism; such that the blind clasp connects the louver to the suspension mechanism and can allow for adjustment of the height above a surface over which the louver is suspended.

The invention also provides a method for adjustably attaching a vertical blind louver to a vertical blind suspension mechanism consisting of the steps of: providing a vertical blind clasp with a first end to detachably but securely hold a vertical blind louver and a second end with at least one securing point to detachably but securely connect the clasp to a holder of a vertical blind suspension mechanism; connecting a vertical blind louver to the first end of the clasp; connecting the second end of the clasp to the suspension mechanism such that the connection of the clasp to the louver and then the holder allows for adjustment of the height of the louver with respect to a surface above which the louver is suspended. In a further aspect the method includes the additional step of providing a clasp with a plurality of securing points so that the height of the louver can be varied with respect to a surface above which it is suspended.

BRIEF DESCRIPTION OF THE DRAWINGS

The invention will be better understood by an examination of the following description, together with the accompanying drawings, in which.

DETAILED DESCRIPTION OF THE PREFERRED EMBODIMENT

Figure 1:
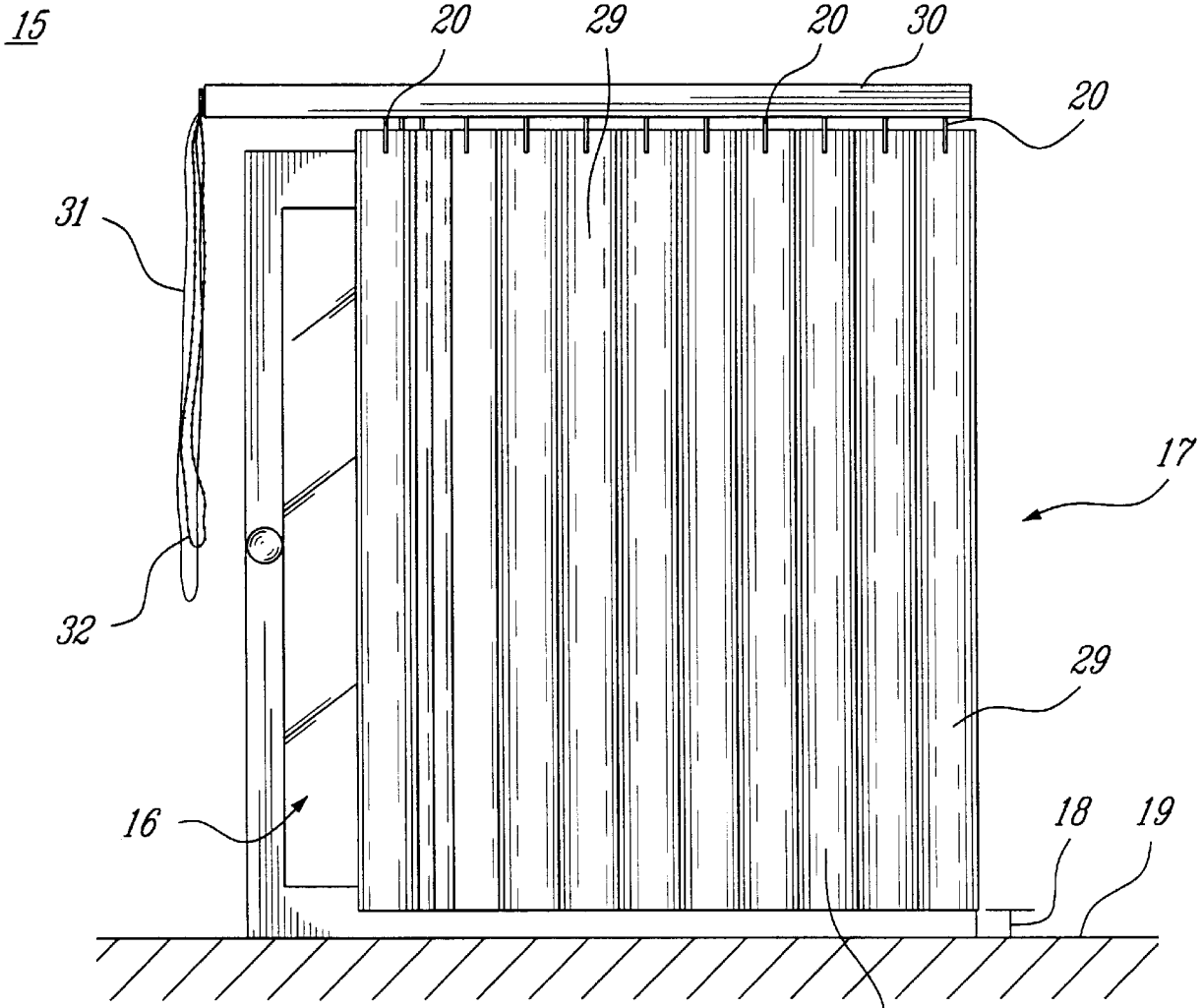
FIG. 1 is a view of a vertical blind employing the present invention.

FIG. 1 is a view of a standard vertical blind 17 which provides cover for an opening 16 in an exterior wall 15 of a building. The vertical blind 17 is located on the interior side of the wall 15. The vertical blind consists of a vertical blind frame 30 attached, in a manner well know in the industry, in a horizontal position above the opening 15. The louvers 29 of the vertical blind 17 are suspended below the frame 30.

Figure 2:
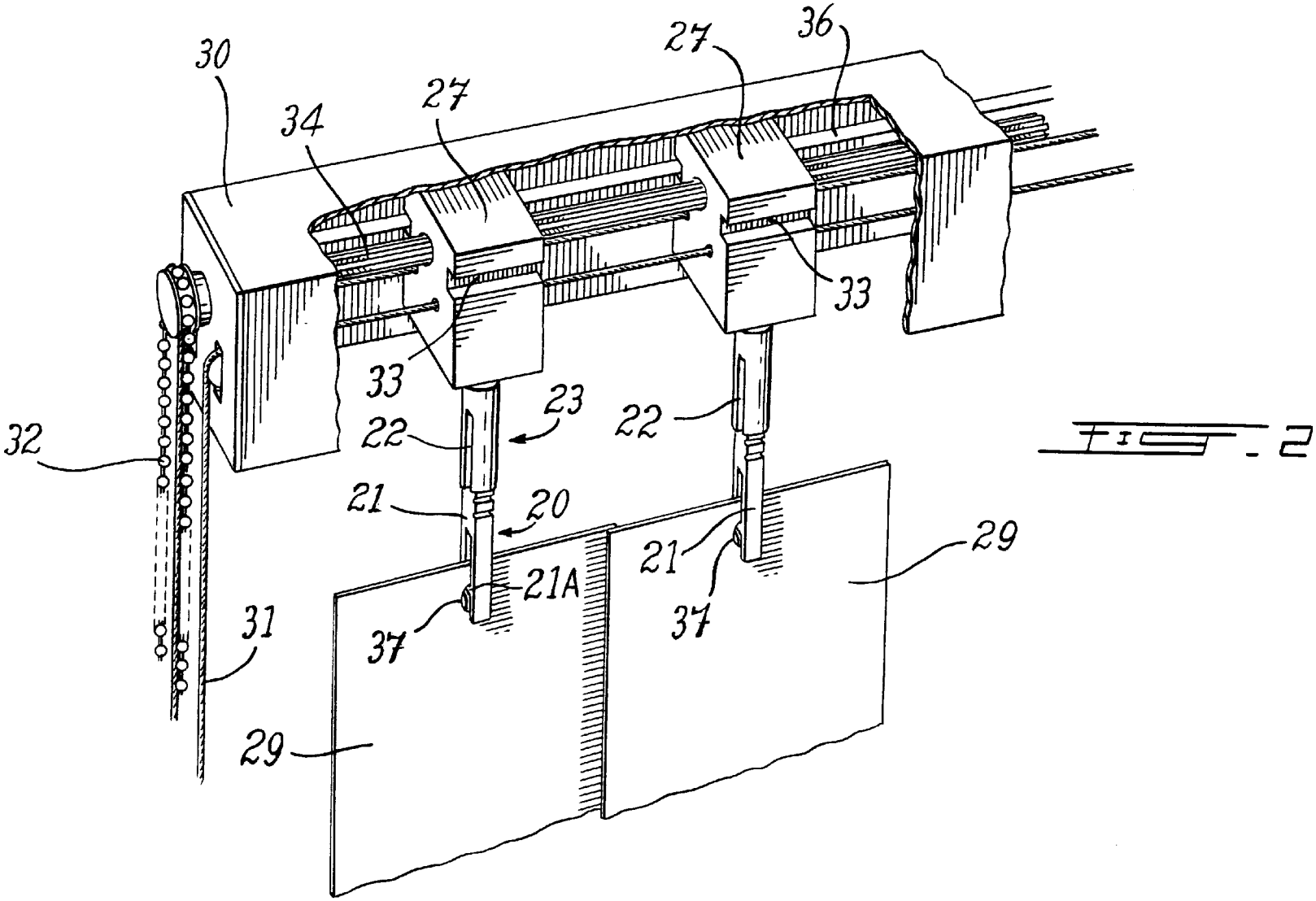
FIG. 2 is a perspective view of a vertical blind employing the present invention with a portion of the frame cut away.

Referring to FIG. 2, a lower end 21 of the adjustable blind clasp 20, of the present invention, holds the louver 29 securely. An upper end 22 of the adjustable blind clasp 20 of the present invention connects to holder 23. The holder 23 in turn attaches to suspension assembly 27. The holders 23, clasps 20 and suspension assemblies 27 will be discussed in more detail below.

Referring to FIG. 1, the louvers 29 are suspended over a surface 19 which generally is a floor, although in some applications the surface can be a window sill, not shown or some similar generally interior surface. A small gap 18 is necessary so that the louvers 29 of the blind 17 can freely move back and forth as the blind 17 is opened or closed. An important aspect of this invention is that the use of the adjustable blind clasp 20 allows one to vary the height 18 of the lower end of the louvers 29 are suspended over surface 19. As it will become clearer below, one can easily change the height or gap 18 simply by moving the clasp 20 up and down in the holder 23 see FIGS. 2, 3B, 3C and 6.

As is well known in the in the industry the standard fashion for providing for lateral movement of the louvers 29 across the opening 16 generally is a type of pulley and rail system controlled by a cord 31. Chain 32 manipulates a standard types of gear mechanism, not shown, located in each suspension assembly 27. Pulling of chain 32 rotates the louvers about a central vertical axis. It is common knowledge that when the louvers 29 are drawn out over the opening 16 rotating the louvers 29 to the open position allows in light and provides a view out of the opening the blind covers. Rotating the louvers 29 to the closed position shuts out light and provides privacy.

FIG. 2 is a cut-away view of a portion of a standard vertical blind 17. Although the actual mechanisms will vary from manufacturer to manufacturer FIG. 2 shows most of the components of a typical vertical blind with which the adjustable blind clasp 20 of the current invention would work. The frame 30 provides an overall housing and support of the other parts of the blind. The suspension assembly 27 has rail groves 33 which fit onto the rails 36 and thus provides support to the suspension assembly 27 and allow the suspension assembly 27 to slides along on rails 36. Since a cut away drawing is provided only one rail 36 on one side is shown there also being a rail on the cut away side of the vertical blind frame 30. The suspension assemblies 27 contain a gear mechanism, not shown, but well known in the art, which rotates the louver 29 about a vertical axis. The gear mechanism rotates the louver 29 when activated by the turning of shaft 34 with chain 32. In some variations the suspension assemblies are open plates which ride on top of the rails with the gear mechanism for rotating the louvers resting on top.

Movement of the suspension assemblies along the rails 36 is accomplished by pulling in the appropriate direction on cord 31. The cord 31 can be attached in a number of different ways, well known in the art, which allows one to draw all of the louvers 29 to one side of the opening 16 FIG. 1 to completely expose the opening 16 or to draw all of the louvers 29 across the opening 16 to cover it either partially or wholly depending on the orientation the louvers 29 are rotated to by manipulation of chain 32. Some vertical binds part the louvers in the center and draw them to both sides; however, those skilled in the art will see that the present invention is just as easily adaptable to this type of vertical blind.

The preceding is only a very general discussion of the overall structure of a vertical blind 17 and ment only to provide background for a description of the invention herein. Those skilled in the art will appreciate that the actual structures and mechanisms vary significantly from manufacturer to manufacturer but the overall concepts are the same.

Figure 3C:
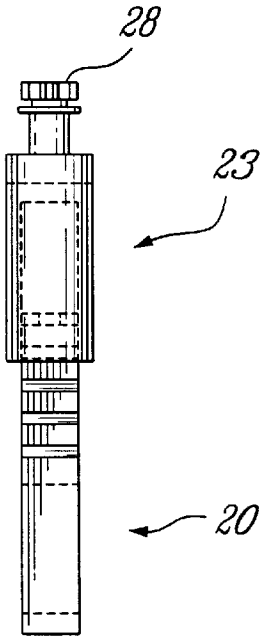
FIG. 3C is a front view of the clasp and holder of FIG. 3B.
Figure 3B:
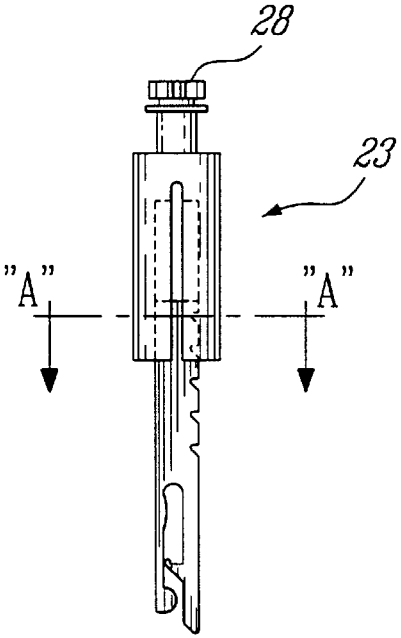
FIG. 3B is a side view of the clasp depicted in FIG. 3A connected to the holder.
Figure 3D:
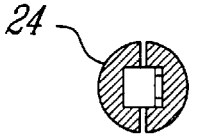
FIG. 3D is a view of the cross section "A—A" of FIG. 3B.
Figure 3A:
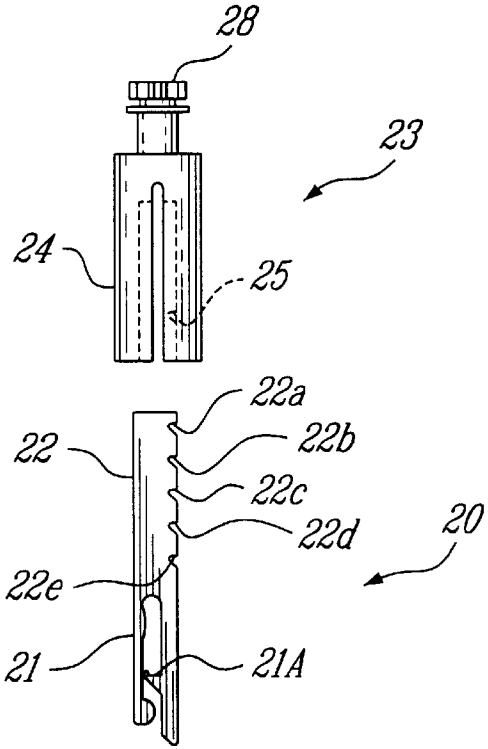
FIG. 3A is a view of one version of the preferred embodiment of the clasp of the present invention with the holder with which it could be used.
Figure 3E:
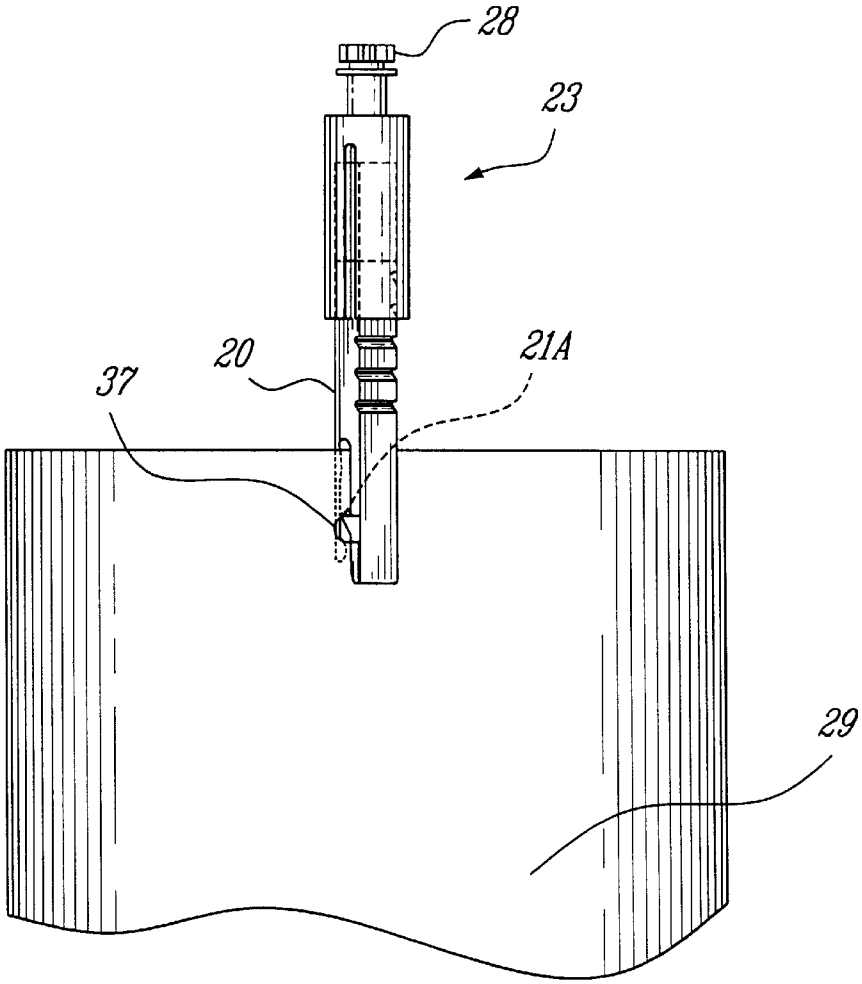
FIG. 3E is a view of a holder, clasp and a portion of louver connected together.
Figure 6:
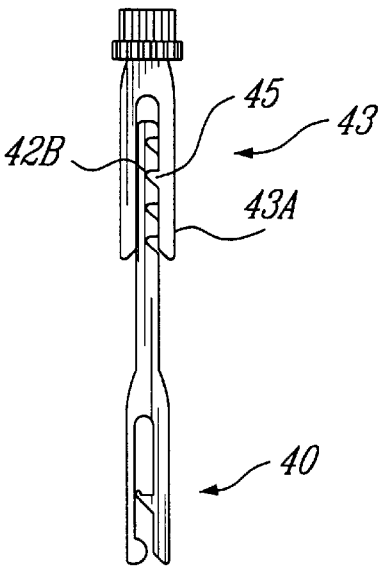
FIG. 6 depicts the clasp of FIG. 5 and the holder of FIG. 4 joined.

One version of the invention as depicted in FIG. 3A provides an adjustable blind clasp 20 with an elongated "u" shaped gripping end 21 at a first end and a plurality of securing points or rachet groves 22*a* to 22*e* at the opposite end 22. The rachet end 22 of the adjustable blind clasp 20 slips into the shank 24, refer to FIGS. 3B and 3D, of the holder 23. As noted above, and depicted in FIG. 2 the holder at its top gear end 28 fits into the vertical blind suspension assembly 27 FIG. 2. Referring to FIGS. 3A, 3B and 3C the locking tooth 25 of holder 23 catches the individual ratchets 22*a* to 22*e* of the clasp 20 and releaseably holds the clasp 20. The adjustable blind clasp 20 can be moved up or down in the holder 23 so that the locking tooth 25 of the holder 23 holds the adjustable blind clasp 20 in a secure but releasable fashion at any one of the ratchet points 22*a* to 22*e*. Thus, by moving the clasp 20 up or down in the holder the height of the louver 29 above surface 19 of FIG. 1 can be varied to achieve the desired gap 18 between the surface 19 and the bottom of the louver 29.

The louver or slat 29 of a vertical blind can easily be inserted into the gripping end 21 of the adjustable blind clasp 20 and secured by locking tooth 21A. Referring to FIG. 2, the securing or suspension hole or notch 37 of the louver 29 is slipped over the locking tooth 21A of the adjustable blind clasp 20. Adjustable blind clasp 20 then holds the louver 29 in the standard suspended state. As noted above, the louver 29 is rotated in the usual manner to achieve the desired lighting conditions. Adjustment of the height of the louver above the floor 19 is quickly and easily achieved by sliding the adjustable clasp 20 up or down in the holder 23 and securing the clasp 20 on one of its ratchet points to the locking tooth 25 of the holder 23. The actual point 22*a* to 22*e* it is connected on depending on how high 18 above the floor 19 one needs to suspend the louver. The version of the adjustable blind clasp 20 depicted in FIGS. 3A to 3E is designed to fit into a holder 23 which has a square shaft 24 of FIG. 3D. Typically, the holder 23 has a gear 28 at its top which fits into the gear mechanism of the suspension assembly 27 and allows for rotation of the louver 29.

Figure 4:
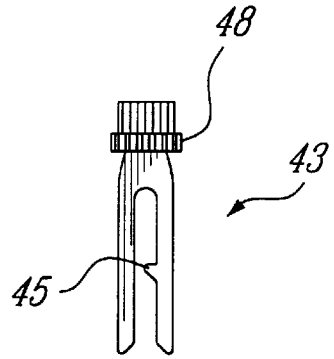
FIG. 4 is a view of different holder.
Figure 5:
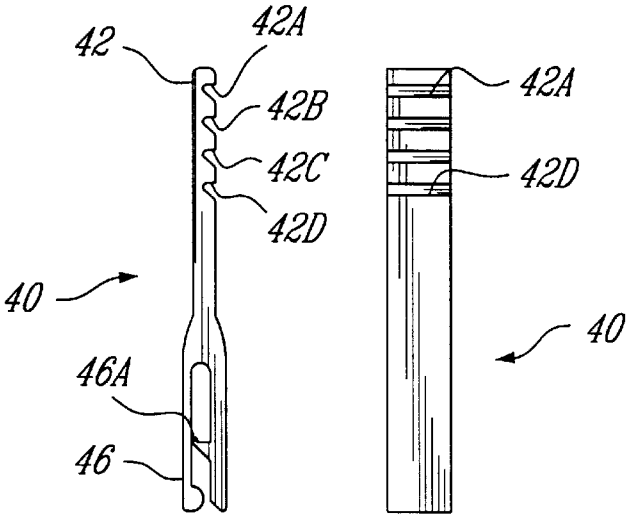
FIG. 5 is a front and side view of an variation of the preferred embodiment of clasp which connects to the holder of FIG. 4.

FIG. 5 depicts a front and side view of another preferred embodiment 40 of the adjustable blind clasp of the present invention. Clasp 40 is structured to work with holder 43 of FIG. 4 another version of the holder in common use. The significant difference in this version is that the adjustable blind clasp 40 has a thin blade shape at the end which fits into to the thin but wide shaft of holder 43. Holder 43 at its clasp gripping end 43A presents a narrow slot into which the clasp 40 has to fit. The locking tooth 45 of holder 43 grips the top 42 of the clasp 40 at any of the ratchet points 42A to 42D. As will be appreciated by those skilled in the art the invention described here in can be configured in a number of different ways to work with a variety of holders but still conform to the general concepts of this invention.

The adjustable blind clasp of the present invention can be sold as part of a new vertical blind and provide for adjustment of blinds upon installation. The adjustable clasp can also be easily designed to function with existing vertical blinds sold by most manufacturers. The clasp could be sold separately and allow the owner of existing vertical blinds to easily retro-fit the clasps onto the blinds so the height of the louvers can be adjusted without having to reinstall the blinds. The clasps also can be manufactured and sold as a separate item so that a purchaser of new vertical blinds from any of number of different manufactures can use them on the initial installation of the blinds.

The adjustable blind clasp of the present invention can be made out of a hard durable but flexible plastic. An injection molding process would provide the preferred method of manufacturing. This would allow for high volume and expeditious manufacturing. Additionally, the clasp could be manufactured together with a holder and sold as a unit with the holder. The holders could be designed to work with the suspension mechanisms of any number of manufactures of vertical blinds.

While the invention has been particularly shown and described with reference to a preferred embodiment thereof, it will be understood by those skilled in the art that various changes in form and detail may be made to it without departing from the spirit and scope of the invention.

I claim:

1. An apparatus for adjusting the height of a vertical blind with respect to a surface, said apparatus comprising:

an adjustable blind clasp with a first end for detachably holding a louver of a vertical blind and a plurality of securing points at a second end, said second end being positionable within a vertical blind suspension mechanism so that one of the securing points detachably engages a holder of the vertical blind suspension mechanism; and wherein each securing point is capable of detachably securing the clasp to the holder such that attaching the clasp at the different securing points allows for the positioning of the louver at different heights above the surface.

2. The apparatus of claim 1 wherein each securing point is a ratchet point.

3. The apparatus of claim 2 wherein the plurality of ratchet points are sequentially spaced along the second end and each ratchet point can be detachably connected to the holder of the blind suspension mechanism so that the vertical blind clasp can be selectively secured by anyone of the ratchet points to the holder of the vertical blind suspension mechanism and thus allow for adjustment of the height above a surface over which the louver is suspended.

4. A vertical blind comprising:

a vertical blind frame attachable in a horizontal orientation to a wall above an opening in the wall, said frame has an array of vertical blind suspension mechanisms;

a vertical blind clasp with a first end to detachably but securely hold a vertical blind louver and a second end with at least two securing points which can be detachably but securely connected to a holder of the vertical blind suspension mechanism;

the suspension mechanisms operate such that they provide for lateral and rotary movement of a vertical blind louver that each suspension mechanism holds; and whereby the blind clasp connects the louver to the suspension mechanism and can allow for adjustment of the height above a surface over which the louver is suspended.

5. The vertical blind of claim 4 wherein the clasp has several securing points spaced out along its second end, each of which is capable of detachably securing the clasp to the holder such that attaching the clasp at the different securing points allows for positioning of the louver the clasp holds at different heights above the surface the louvers are suspended over.

6. The vertical blind of claim 4 wherein the at least two securing points on the clasp are ratchet points.

7. The vertical blind of claim 6 wherein the at least two ratchet points are a plurality of ratchet points.

8. A method for adjustably attaching a vertical blind louver to a vertical blind suspension mechanism comprising the steps of:

providing a vertical blind clasp with a first end to detachably but securely hold a vertical blind louver and a second end with at least two securing points to detachably but securely connect the clasp to a holder of a vertical blind suspension mechanism;

connecting a vertical blind louver to the first end of the clasp;

connecting the second end of the clasp to the suspension mechanism; and wherein the connection of the clasp to the louver and then the holder allows for adjustment of the height of the louver with respect to a surface above which the louver is suspended.

9. The method of claim 8 wherein the step of providing a clasp wherein the at least two securing points comprises providing a clasp with a plurality of securing points so that the height of the louver can be varied with respect to a surface above which it is suspended.

* * * * *